US010271602B2

(12) United States Patent
Halldin et al.

(10) Patent No.: US 10,271,602 B2
(45) Date of Patent: Apr. 30, 2019

(54) CONNECTING ARRANGEMENT AND HELMET COMPRISING SUCH A CONNECTING ARRANGEMENT

(71) Applicant: MIPS AB, Täby (SE)

(72) Inventors: Peter Halldin, Stockholm (SE); Daniel Lanner, Stockholm (SE); Kim Lindblom, Stockholm (SE); Johan Thiel, Stockholm (SE)

(73) Assignee: MIPS AB, Stockholm (SE)

( * ) Notice: Subject to any disclaimer, the term of this patent is extended or adjusted under 35 U.S.C. 154(b) by 96 days.

(21) Appl. No.: 14/785,543

(22) PCT Filed: Apr. 17, 2014

(86) PCT No.: PCT/SE2014/050476
§ 371 (c)(1),
(2) Date: Oct. 19, 2015

(87) PCT Pub. No.: WO2014/171889
PCT Pub. Date: Oct. 23, 2014

(65) Prior Publication Data

US 2016/0073723 A1 Mar. 17, 2016

(30) Foreign Application Priority Data

Apr. 19, 2013 (SE) ..... 1350491
Sep. 6, 2013 (SE) ..... 1351032

(51) Int. Cl.
*A42B 3/06* (2006.01)

(52) U.S. Cl.
CPC ..... *A42B 3/06* (2013.01); *A42B 3/064* (2013.01)

(58) Field of Classification Search
CPC ..... A42B 3/06; A42B 3/064; A42B 3/063; A42B 3/14

(Continued)

(56) References Cited

U.S. PATENT DOCUMENTS 2,197,174 A * 4/1940 Crosby ..... A42B 3/06 2/6.8
2,306,362 A 12/1942 Wolff
(Continued)

FOREIGN PATENT DOCUMENTS

WO WO 2011/139224 A1 11/2011
WO WO 2014/150694 A2 9/2014

OTHER PUBLICATIONS

International Search Report issued by the International Searching Authority of Sweden dated Aug. 8, 2014 for PCT/SE2014/050476, 5 pages.

*Primary Examiner* — Alissa L Hoey
(74) *Attorney, Agent, or Firm* — Perkins Coie LLP

(57) ABSTRACT

The invention relates to a connection arrangement (6) adapted to connect a first (2) and a second part (3) slidably arranged in relation to each other. The connection arrangement (6) is characterized in that said connection arrangement (6) is adapted to allow the sliding movement between the first (2) and the second part (3) in all directions. The arrangement (6) comprises a connection member (7) directly or indirectly connected to at least one of the first part and the second part (2, 3) and a device creating a spring force and/or a damping force (8) during sliding movement between the first and second part (2, 3) adapted to be connected with or to cooperate with said connection member (7). The invention further relates to a helmet (1) comprising a first helmet part (2) to be arranged closer to a wearer's head, a second helmet part (3) arranged radially outside of the first helmet part (2) and at least one connection arrangement (6) according to the above connecting the first and the second helmet part (2, 3).

11 Claims, 4 Drawing Sheets

(58) Field of Classification Search
USPC ..... 2/411, 6.8
See application file for complete search history.

(56) References Cited

U.S. PATENT DOCUMENTS

| | | | | |
|---|---|---|---|---|
| 4,012,794 | A * | 3/1977 | Nomiyama | A42B 3/064 2/411 |
| 4,223,409 | A | 9/1980 | Lee | |
| 6,658,671 | B1 * | 12/2003 | Von Holst | A42B 3/064 2/412 |
| 8,156,569 | B2 * | 4/2012 | Cripton | A42B 3/0473 2/411 |
| 8,182,023 | B2 * | 5/2012 | Nagwanshi | B60R 19/18 296/187.09 |
| 8,316,512 | B2 * | 11/2012 | Halldin | A42B 3/064 2/411 |
| 8,850,622 | B2 * | 10/2014 | Finiel | A42B 3/125 2/410 |
| 9,089,180 | B2 * | 7/2015 | Phipps | A42B 3/12 |
| 9,388,873 | B1 * | 7/2016 | Phipps | B60R 19/28 |
| 9,603,406 | B2 * | 3/2017 | Halldin | A42B 3/064 |
| 2001/0032351 | A1 * | 10/2001 | Nakayama | A42B 3/064 2/412 |
| 2007/0245464 | A1 * | 10/2007 | Baker | A42B 3/0473 2/411 |
| 2008/0163410 | A1 | 7/2008 | Udelhofen | |
| 2012/0198604 | A1 | 8/2012 | Weber et al. | |
| 2012/0233745 | A1 | 9/2012 | Veazie | |
| 2013/0042397 | A1 * | 2/2013 | Halldin | A42B 3/064 2/411 |
| 2013/0061371 | A1 | 3/2013 | Phipps et al. | |
| 2013/0152282 | A1 * | 6/2013 | Ellis | A43B 7/1425 2/413 |
| 2013/0232668 | A1 * | 9/2013 | Suddaby | A42B 3/064 2/413 |
| 2013/0298316 | A1 * | 11/2013 | Jacob | A42B 3/12 2/414 |
| 2014/0007322 | A1 * | 1/2014 | Marz | A42B 3/065 2/411 |
| 2014/0215694 | A1 * | 8/2014 | Grice | A42B 3/06 2/411 |
| 2015/0208751 | A1 * | 7/2015 | Day | A42B 3/124 2/414 |
| 2015/0359285 | A1 * | 12/2015 | Rennaker, II | A42B 3/064 2/414 |
| 2016/0161222 | A1 * | 6/2016 | Lee | A42B 3/065 2/416 |
| 2016/0165993 | A1 * | 6/2016 | Knight | A42B 3/064 2/411 |

* cited by examiner

CONNECTING ARRANGEMENT AND HELMET COMPRISING SUCH A CONNECTING ARRANGEMENT

TECHNICAL FIELD

The present invention relates generally to a connecting arrangement connecting a first and a second slidably arranged part and absorbing a force, and a helmet comprising such a connecting arrangement. The invention also relates to a helmet comprising a first and a second helmet part and a connecting arrangement connecting the two parts.

BACKGROUND ART

It is a problem to create a structure absorbing energy at oblique impacts generating tangential force components, for example an impact between a person and a moving object or surface. The structure may for example be a helmet, a protective clothing or other force absorbing structures.

In prior art there are presented a number of solutions comprising at least a first and a second layer or part which are slidably moveable in relation to each other in order to absorb an impact force. In order to function properly the layers are connected by one or several connecting arrangements.

In one embodiment the structure is a helmet. Most helmets comprises a hard outer shell, often made of a plastic or a composite material, and an energy absorbing layer, called a liner, of energy absorbing material. Nowadays, a protective helmet has to be designed so as to satisfy certain legal requirements which relate to inter alia the maximum acceleration that may occur in the center of gravity of the head at a specified load. Typically, tests are performed, in which what is known as a dummy skull equipped with a helmet is subjected to a radial blow towards the head. This has resulted in modern helmets having good energy-absorption capacity in the case of blows radially against the skull while the energy absorption for other load directions is not as optimal.

In the case of a radial impact the head will be accelerated in a translational motion resulting in a translational acceleration. The translational acceleration can result in fractures of the skull and/or pressure or abrasion injuries of the brain tissue. However, according to injury statistics, pure radial impacts are rare.

On the other hand, a pure tangential hit that result in a pure angular acceleration to the head are rare, too.

The most common type of impact is oblique impact that is a combination of a radial and a tangential force acting at the same time to the head. The oblique impact results in both translational acceleration and angular acceleration of the brain. Angular acceleration causes the brain to rotate within the skull, creating injuries on bodily elements connecting the brain to the skull and also to the brain itself.

Examples of rotational injuries are on the one hand subdural haematomas, SH, bleeding as a consequence of blood vessels rupturing, and on the other hand diffuse axonal injuries, DAI, which can be summarized as nerve fibers being over stretched as a consequence of high shear deformations in the brain tissue. Depending on the characteristics of the rotational force, such as the duration, amplitude and rate of increase, either SH or DAI occur, or a combination of these is suffered. Generally speaking, SH occur in the case of short duration and great amplitude, while DAI occur in the case of longer and more widespread acceleration loads.

It is important that these phenomena are taken into account so as to make it possible to provide good protection for the skull and brain.

The head has natural protective systems adapted to dampen these forces using the scalp, the hard skull and the cerebrospinal fluid between the skull and the brain. During an impact, the scalp and the cerebrospinal fluid acts as rotational shock absorber by both compressing and sliding over and under the skull, respectively. Most helmets used today provide no protection against rotational injury.

In the applicant's prior applications WO2011139224A1 and EP1246548B1 it is described a helmet comprising a first and a second helmet part slidably arranged in relation to each other to protect against rotational injury. The first helmet part is arranged closer to a wearers head and the second part is arranged radially outside the first helmet part.

Further it is in WO2011139224A1 and EP1246548B1 described several ways of connecting the first helmet part with the second helmet part. The connecting arrangements are arranged to absorb energy by deforming in an elastic, semi-elastic or plastic way when large enough strain are applied to the outer helmet part.

When using these connection arrangements it is difficult to control the motion between the first and second part and thus also the force absorption curve.

SUMMARY

An object of the present invention is to provide a solution to the problem of controlling the force absorbing motion between a first and a second part slidably arranged in relation to each other, especially within the field of force absorbing structures such as for example helmets. The solution is provided by the below described connection arrangement and a helmet comprising such a connection arrangement.

The invention relates to a connection arrangement adapted to connect a first and a second part slidably arranged in relation to each other. The invention is characterized in that said connection arrangement is adapted to allow the sliding movement between the first and the second part in all directions. Thus, the first and second layer or part is possible to move in relation to each other at least in a direction essentially parallel to the extension directions of the first and second parts. However, they do not have to have a common sliding surface and may be arranged at a distance from each other. The connection arrangement comprises a connection member directly or indirectly connected to at least one of the first part and the second part and at least one device creating a spring force and/or a damping force during sliding movement between the first and second part adapted to be connected with or to cooperate with said connection member. Thus the first and second part are not detachable by a minor force to the second part, but are connected.

A connection arrangement comprising a connecting member acting on one or more separate devices creating a spring force and/or a damping force is able to better absorb the forces acting on the first or the second part. This construction is especially improving the absorption of the tangential force component originating from oblique force acting on the first or second part which creates a sliding movement of the first and second part relative to each other. Thus, at least a part of the energy originating from an oblique impact may be absorbed in the connecting members. Further, it is easier to control the sliding movement by adapting the construction of the separate parts of the least one device creating a spring force and/or a damping force to the forces estimated to act on the first and second part. The device creating a spring force and/or a damping force may for example be designed to have a linear or progressive spring or damping characteristics with differing spring and damping constants. Said at least one device creating a spring force and/or a damping force may be attached to or embedded in either one of the first or the second part. It is also an aim to minimize the intrusion of the energy absorbing layer, liner, so that radial forces will be absorbed sufficiently also at the positions of the connection arrangements.

A sliding facilitator may be arranged between the first and the second parts to facilitate the sliding movement between the first and second parts in response to a force created by an oblique impact on the first or second part.

This sliding facilitator facilitates the sliding movement between the first and second part in response to the impact force. However, it is also conceivable to leave out the sliding facilitator. The sliding facilitator may be a material creating low friction between the first and the second part. The sliding facilitator may be a separate piece such as a layer or a material embedded in or attached to one or both of the surfaces of the first and/or the second part which are adapted to slide against each other.

The connection member is an elongated member connected to the device creating a spring force and/or a damping force. The connection member may for example be an inelastic part having a predetermined length.

The elongated member has an inelastic predetermined length and creates the connection between the first and the second part. At least part of the energy originating from an oblique impact on the second part and not absorbed by the sliding itself or any other energy absorbing layers is then absorbed in the device creating a spring force and/or a damping force. Thus, the inelastic connection member does not absorb any energy; it is merely acting as a force transmitter. The energy absorbed in the device creating a spring force and/or a damping force can be absorbed by friction heat, energy absorbing layer deformation or deformation or displacement of internal parts of the device creating a spring force and/or a damping force.

In a first embodiment of a connection arrangement said connection member is a bendable elongated member connected in one end to the device creating a spring force and/or a damping force and in the other end to either one of the first or second part. The first embodiment of the connection arrangement transfers the motion between the first and second part, a motion possible in any direction, to a motion along one axis, irrespective of the direction of the movement between the first and second parts. This is possible due to the bendability of the connection member. This makes it possible to absorb energy in a controlled way.

The connection member may be a cord, rope, line, wire or similar elongated bendable member. Preferably, the elongated bendable member is inelastic and of a predetermined length.

In another embodiment of a device creating a spring force and/or a damping force, preferably connected to a connection arrangement according to the second embodiment, said device creating a spring force and/or a damping force is a moveable or elastic dividing wall arranged in a housing.

The dividing wall is connected to either one or both of the first and the second part via an at least one connection arrangement according to the second embodiment. The dividing wall might be a piston moveably arranged in the housing, an elastic membrane or similar objects able to move when subjected to an external force via the connection member. The moveable wall creates a first and a second chamber in the housing.

In another embodiment, of a device creating a spring force and/or a damping force, preferably connected to a connection arrangement according to the second embodiment, said housing is essentially closed off from the surroundings and contains a compressible medium.

When a compressible medium, such as gas, is arranged in the housing the movement of the piston creates a compression of the medium, thus an additional force opposite the external force is created. This additional force is a force damping the movement of the dividing wall in the housing, thus is also dampens the relative movement between the first and second part.

In another embodiment of a device creating a spring force and/or a damping force, preferably connected to a connection arrangement according to the second embodiment, said housing is essentially closed off from the surroundings and contains a non-compressible medium.

When a non-compressible medium, such as for example fluid, is used in the housing the chambers on respective sides of the wall need to be connected so that the medium can flow between the chambers. Either an outside channel is arranged between the chambers or in another embodiment the dividing wall itself is arranged to permit a leak of medium, for example by using holes or other openings. The movement of medium between the chambers creates a damping force. The damping force is dependent on the flow area of the connecting passages.

In another embodiment of a device creating a spring force and/or a damping force, preferably connected to a connection arrangement according to the second embodiment, at least one spring is arranged to act upon said dividing wall creating a spring force. Said spring may be a linear, non-linear or progressive spring of any kind.

The spring may be biased between the dividing wall and the end of the housing or any other supporting structure. It is also possible to use two springs acting on the opposite sides of the dividing wall.

In another embodiment of a device creating a spring force and/or a damping force, preferably connected to a connection arrangement according to the first embodiment, but also possible in connection with the second embodiment, said housing comprises notches, slots or friction increasing members controlling the movement of the dividing wall.

The notches may be of a material increasing the friction between the dividing wall and the housing. They may also be used to create an increase in the initial force necessary to start the movement of the dividing wall. It is also possible to arrange notches or slots on the inner wall of the housing in a patter similar to a spiral thread. This creates a rotational movement of the wall in the housing which is able to absorb energy.

In a second embodiment of a connection arrangement said at least one connection member is an elongated rigid pin connected in its first or second end to the first or the second part and connected in or between its first and second end to the device creating a spring force and/or a damping force.

In one embodiment of a device creating a spring force and/or a damping force, preferably connected to a connection arrangement according to the second embodiment, but also possible in connection with the first embodiment, the at least one device creating a spring force and/or a damping force is a torsion, leaf or spiral spring connected to or acting against the connection member and either one of the first or second part. It is also possible to arrange a protrusion or the like to create an increase in the initial force necessary to start the movement between the first and second part.

The at least one device creating a spring force and/or a damping force may encircle the connection member or may be arranged to protrude in an essentially radial direction from the connection member.

In one embodiment said first part is a first helmet part arranged closer to a wearer's head and said second part is a second helmet part arranged radially outside of the first helmet part.

Another aspect relates to a helmet comprising a first helmet part arranged closer to a wearer's head and a second helmet part arranged radially outside of the first helmet part. The helmet is characterized in that said at least one connection arrangement is adapted to allow the sliding movement between the first and the second helmet part in all directions and comprises a connection member directly or indirectly connected to at least one of the first helmet part and the second helmet part and a device creating a spring force and/or a damping force during sliding movement between the first and second helmet part adapted to be connected with or to cooperate with said connection member.

In one embodiment of said helmet, said device creating a spring force and/or a damping force is attached to either one of the first or the second helmet part.

In another embodiment of said helmet, the helmet further comprises a sliding facilitator arranged between the first and the second helmet parts to enable a sliding movement between the first and second helmet part in response to a rotational force created by an oblique impact on the helmet and at least one connection arrangement connecting the first and the second helmet part.

Please note that any embodiment or part of embodiments as well as any method or part of method could be combined in any way.

BRIEF DESCRIPTION OF DRAWINGS

The invention is now described, by way of example, with reference to the accompanying drawings, in which.

DESCRIPTION OF EMBODIMENTS

In the following, a detailed description of the different embodiments is presented. It will be appreciated that the figures are for illustration only and are not in any way restricting the scope.

A first and second, in relation to each other slidably arranged, parts are components of an energy absorbing structure, such as for example a helmet, protective clothing or a vehicle interior. At least one connection arrangement is adapted to connect the first and second parts. The connection arrangement comprises at least one connection member and at least one device creating a spring force and/or a damping force.

The at least one connection member is directly or indirectly connected to the first or the second part and is adapted to allow a sliding movement between the first and the second part in all directions. Movements in all directions meaning a sliding movement in all directions from the connection point or points. The connection member is also connected to or cooperates with the at least one device creating a spring force and/or a damping force. The at least one device creating a spring force and/or a damping force is attached either to the first part or to the second part. It is also possible to arrange a device creating a spring force and/or a damping force in both parts with the connecting member as a connecting part.

Figure 1:
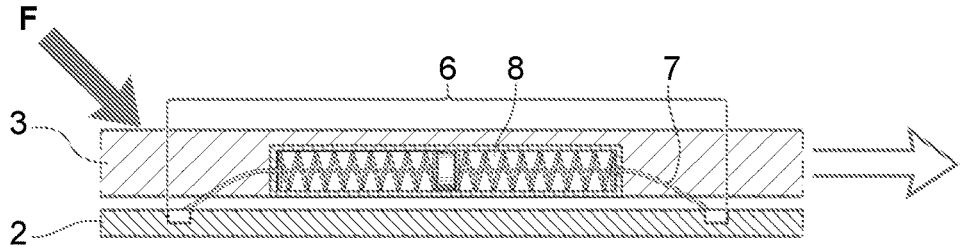
FIG. 1 shows an energy absorbing structure comprising a first and a second part connected by a connection arrangement.

In the embodiment according to FIG. 1 an energy absorbing structure is shown. The structure comprises a first and a second part 2, 3 which are slidably moveable in relation to each other in order to absorb an oblique impact force F. The parts 2, 3 are connected by at least one connecting arrangement 6 comprising at least one connection member 7 and at least one device creating a spring force and/or a damping force 8. Between the first 2 and the second part 3 the sliding occurs.

The sliding movement may be facilitated by a sliding facilitator 4. This sliding facilitator 4 facilitates a sliding movement between the first and second part in response to the force F. However, it is also conceivable to leave out the sliding facilitator 4.

The sliding facilitator may be a material creating low friction between the first and the second part 2, 3. The sliding facilitator 4 may be a separate piece such as a layer or a material embedded in or attached to both or either one of the surfaces of the first or the second part 2, 3 which are adapted to slide against each other. Depending on the type of sliding facilitator used it may be arranged between the first and second part 2, 3, on the surface of second part 3 facing the first part 2, on the surface of the first part 2 facing the second part 3 or on both the towards each other facing surfaces. The sliding facilitator 4 could be a material having a low coefficient of friction or be coated with a low friction material: Examples of conceivable materials are PTFE, ABS, PVC, PC, HDPE, nylon, fabric materials. It is furthermore conceivable that the sliding is facilitated by the structure of the material, for example by the material having a fiber structure such that the fibers slide against each other or different type of micro structures facilitating the sliding or structures possible to shear, see for example the sliding facilitator 4 visualized in FIG. 4. The low friction material could be a waxy polymer, such as PTFE, PFA, FEP, PE, UHMWPE, oil, grease Teflon or a powder material which could be infused with a lubricant. It is also conceivable that the first helmet part 2 made up of a semi-rigid polymer material having a surface with sufficiently low friction coefficient in order to function as a sliding facilitator 4. Examples of materials to be used for this purpose are ABS, PC, HDPE.

The energy absorbing structure as shown in FIG. 1, may be protection devices and/or protection clothing or be used between a first and an second layer covering a part, parts or an entire interior of a craft moving on land, in water or in the air.

In the embodiments shown in FIGS. 2*a*, 2*b*, 3*a*, 4, and 5*a* the energy absorbing structure is a helmet 1.

Figure 2A:
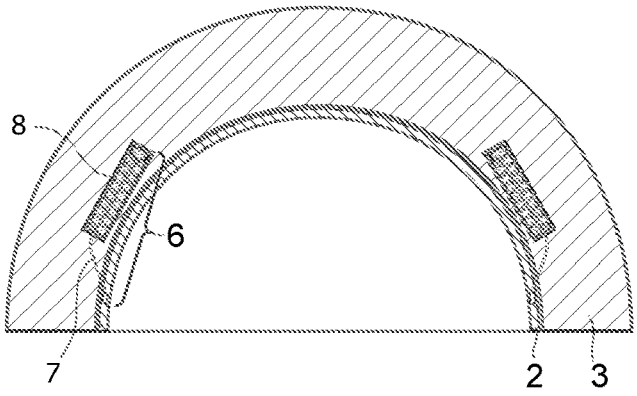
FIGS. 2*a* and 2*b* shows an energy absorbing structure in the form of a helmet of a first type under the influence of an oblique external force.
Figure 2B:
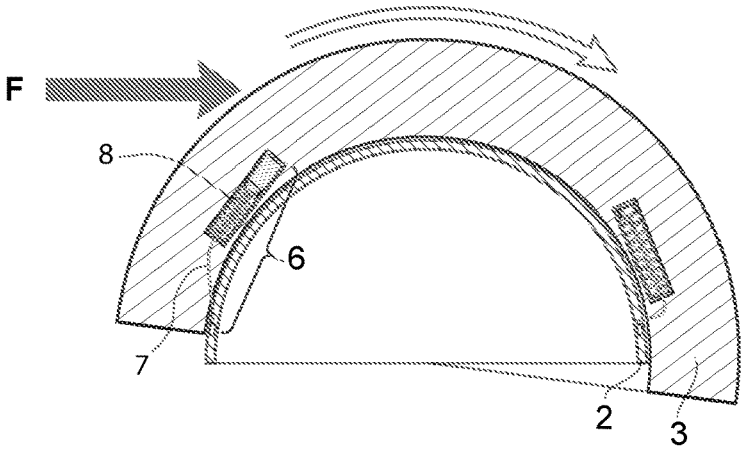

The helmet 1 comprises a first helmet part 2 to be arranged closest to a wearer's head and a second helmet part 3 arranged radially outside of the first helmet part 2. Between the first 2 and the second helmet parts 3 the sliding occurs in response to a tangential force created by an oblique impact F on the helmet. In the helmet application, said tangential force will then result in a relative motion between part 2 and 3. The length of the relative movement between the first 2 and the second helmet part 3 is a distance in the interval 0-100 mm, usually within the interval 0-50 mm and most often within the interval 1-20 mm. The connection arrangement 6 comprising at least one connection member 7 and at least one device for creating a spring force 8 and/or a damping force for the absorption of impact energy and forces. The resulting spring and damping force acting between part 2 and 3 will be in the interval 1-1000 N, usually in the interval 1-500 N and most often in the interval 1-50 N. The velocity of the relative movement may vary from 1-100 m/s. The connection member 7 may be an elongated member connected to the at least one device creating a spring force and/or a damping force 8, thus to a device being able to absorb impact energy and forces. The impact energy in need to be absorbed depends on the force of the impact and the possible relative movement between the first and the second helmet parts 2, 3. The energy is absorbed by displacement of the at least one connection member 7 and the deformation or movement of the device creating a spring force and/or a damping force 8. The connection member 7 may be an inelastic member having a predetermined length. The definition inelastic member should be understood as a member where kinetic energy is not conserved by deformation. The sliding movement may be facilitated by a sliding facilitator 4 as described above, see FIG. 3*a*. This sliding facilitator 4 facilitates a sliding movement between the first and second helmet part. However, it is also conceivable to leave out the sliding facilitator 4, as shown in FIGS. 2*a* and 2*b*.

Figure 3A:
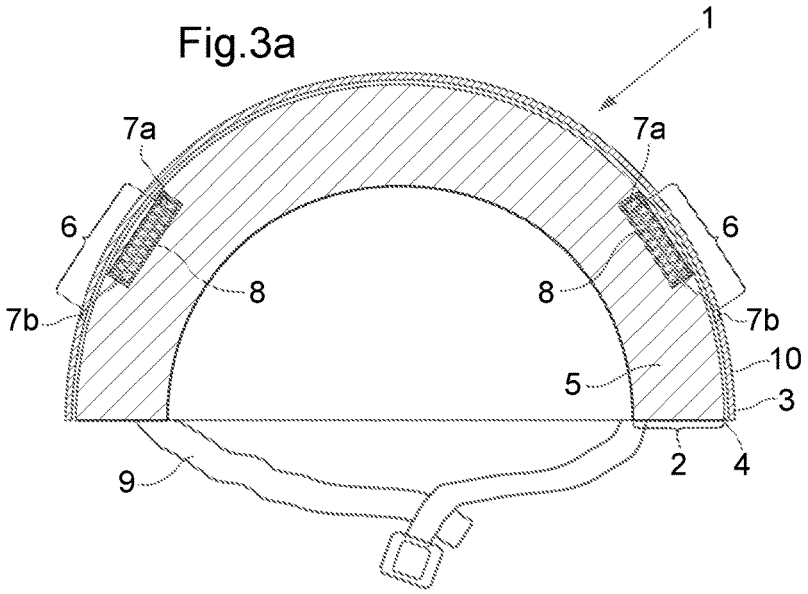
FIG. 3*a* shows a first embodiment of a connection arrangement comprising a first embodiment of a device for creating a spring and/or damping force mounted in a helmet in of a second type.
Figure 3B:
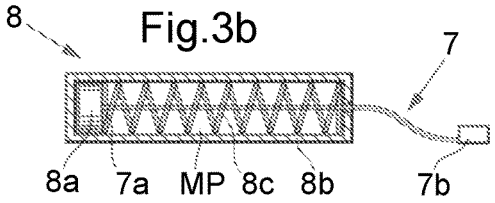
FIG. 3*b* shows a detail view of the first embodiment of a connection arrangement comprising the first embodiment of a device for creating a spring and/or damping force.
Figure 4:
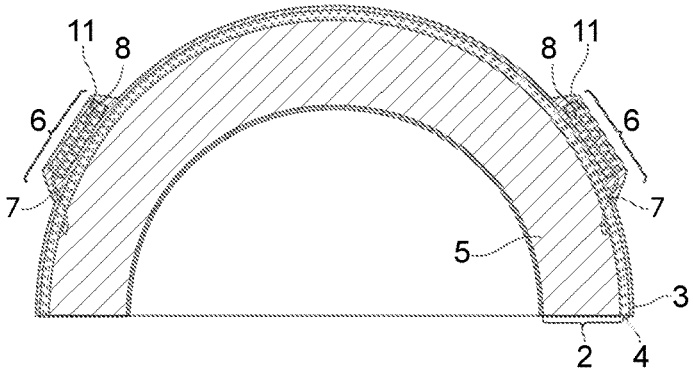
FIG. 4 shows the first embodiment of a connection arrangement comprising a first embodiment of a device for creating a spring and/or damping force mounted in a helmet of a third type. This figure also shows a different type of sliding facilitator possible to use in all helmet types.

The first or the second helmet part 2, 3 or both may comprise an energy absorbing layer 5 absorbing mainly radial forces, see for example FIGS. 3*a* and 4. However, some energy absorbing materials may also absorb some tangential forces. During an impact; the energy absorbing layer acts as an impact absorber by deforming the energy absorbing layer 5.

It is preferred to minimize the reduction of the layer of the energy absorbing material 5 at the positions of the connection arrangements 6 in order to be able to absorb radial forces also at these positions. At least 50% of the energy absorbing layer should remain at these positions and preferably 75% should remain.

The first helmet part 2 may also comprise attachment means 9 for fitting the helmet on the wearer's head, see FIG. 3*a*. It is also conceivable to arrange attachment means at the second helmet part 3 instead. It is also possible to arrange comfort padding in the first helmet part 2, which is adapted to be in contact with the wearers head. Additionally an outer rigid shell 10 could be arranged radially outside the second helmet part 3, for example in a helmet type as shown in FIG. 2*a*. It is also conceivable to leave out the outer shell.

In FIGS. 2*a* and 2*b* the sliding and relative movement of the first and second parts 2, 3 during an oblique impact force F is shown. During an impact, the energy absorbing layer acts as an impact absorber by deforming the energy absorbing layer 5 and if an outer shell 10 is used, see for example FIG. 3*a*, it will spread out the impact energy over the shell. During an oblique impact the sliding occur between the first and the second helmet part 2, 3 allowing for a controlled way to absorb the rotational energy otherwise transmitted to the brain. The rotational energy is mainly absorbed by displacement of the at least one connection member 7 and the deformation or movement of the at least one device creating a spring force and/or a damping force 8. The absorbed rotational energy will reduce the amount of angular acceleration affecting the brain, thus reducing the rotation of the brain within the skull. The risk of rotational injuries such as concussion, subdural hematomas and DAI is thereby reduced.

Figure 5A:
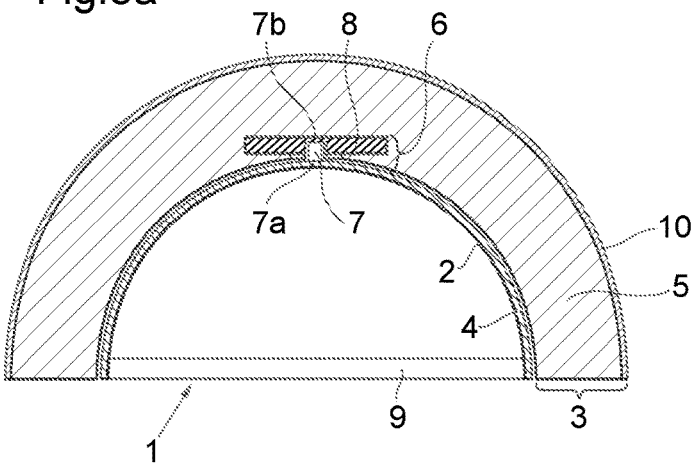
FIG. 5*a* shows a second embodiment of a connection arrangement comprising an eleventh embodiment of a device for creating a spring and/or damping force mounted in a helmet of a first type.
Figure 5B:
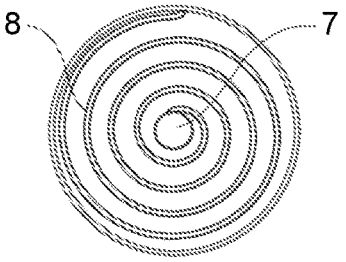
FIG. 5*b* shows detail view of the second embodiment of a connection arrangement comprising the eleventh embodiment of the device for creating a spring and/or damping force.

A first type of helmet is disclosed in FIGS. 2*a*, 2*b* and 5*a*. According to this embodiment, the second helmet part 3 is adapted to absorb the radial forces, thus may comprise an energy absorbing layer 5. The energy absorbing layer may be entirely made of or partly comprise a polymer foam material such as EPS (expanded poly styrene), EPP (expanded polypropylene), EPU (expanded polyurethane), PU (polyurethane) or other structures and materials like honeycomb, rubber or corrugated cardboard or other corrugated material for example. Honeycomb, rubber and corrugated materials are examples of materials having the possibility to absorb both radial and tangential forces. The radial forces may be absorbed by compression of the material and the tangential forces may be absorbed by shearing of the internal structure of the material. The sliding between the parts occur mainly inside of the energy absorbing layer 5, thus between the first helmet part 2 and the energy absorbing layer 5 of the second helmet part 3. A sliding facilitator 4 according to the above described may also be provided at that location to facilitate the sliding. However, it is also conceivable to leave out the sliding facilitator 4.

The first helmet part 2 may be made of an elastic or semi-elastic material such as for example PVC, PC, Nylon, PET. The first helmet part 2 may act as an integral sliding facilitator. The first helmet part 2 may also comprise attachment means 9 for fitting the helmet on the wearer's head for example a chin band or a head encircling device such as a head band or a cap. The attachment means 9 may additionally have tightening means (not shown) for adjustment of the size and grade of attachment to the top portion of the head. The attachment means could be made of an elastic or semi-elastic polymer material, such as PC, ABS, PVC or PTFE, or a natural fiber material such as cotton cloth. Additionally an outer rigid shell 10 could be arranged radially outside the second helmet part 3. The shell may be made of a polymer material such as polycarbonate, ABS, PVC, glass fiber, Aramid, Twaron, carbon fiber or Kevlar. It is also conceivable to leave out the outer shell. The at least one device creating a spring force and/or a damping force 8 of the at least one connection arrangement 6 (in this embodiment two connections arrangements 6 are shown but more than two is preferably used) attached in a first location close to or embedded in the inside of the second part 2, between the first and the second part 2, 3. This type of helmet can for example be a bicycle, hockey or equestrian helmet, preferably an inmould helmet.

A second type of helmet is disclosed in FIG. 3*a*. Here the first helmet part 2 is adapted to absorb the radial forces, thus may comprise the energy absorbing layer 5 which may be made of the same materials as described above. The second helmet part 3 is arranged radially outside of the first helmet part 2 and may be made of an elastic or semi-elastic material such as for example PVC, PC, Nylon, PET. The second helmet part 3 may in this embodiment also act as the rigid shell 10 and may then be made out of for example a polymer material such as ABS, glass fiber, Aramid, Twaron, carbon fiber or Kevlar. The sliding between the parts 2, 3 occur outside of the energy absorbing layer 5, thus between the second helmet part 3 and the energy absorbing layer 5. A sliding facilitator 4 may also be provided at that location to facilitate the sliding. The at least one device creating a spring force and/or a damping force 8 of the connection arrangement 6 is attached in a second location close to or embedded in the outside of the first part 2, between the first and the second part 2, 3. The at least one device creating a spring force and/or a damping force 8 may for example be attached to or embedded in the energy absorbing layer 5. This type of helmet can for example be a motorcycle helmet.

A third type of helmet with a similar construction as the second helmet type is disclosed in FIG. 3*a* is shown in FIG. 4. As in the second helmet type, the first helmet part 2 comprises the energy absorbing layer 5 and the sliding occur outside the energy absorbing layer 5, thus between the second part 3 and the energy absorbing layer 5. The sliding facilitator 4 is in this embodiment a structure attached to both the first and the second part 2, 3 which has a structure possible to shear when oblique forces act no the first part 3. This type of sliding facilitator is of course possible to use on all types of helmets. It is also possible to use a sliding facilitator of any kind mentioned above. However, the at least one device creating a spring force and/or a damping force 8 of the at least one connection arrangement 6 (in this embodiment two connections arrangements 6 are shown but more than two is preferably used) is attached in a third location on the outside of the second part 3 and the connection member 7 runs through openings in the second part 3. The at least one device creating a spring force and/or a damping force 8 may be arranged in a separate housing 12 on the outside of the second helmet part 3. This type of helmet can for example be a football helmet.

Now once again turning back to FIG. 3*a*-3*j*, where a first embodiment of the connection member 7 is shown. Here the connection member 7 is an elongated bendable non-elastic member connected in its first end 7*a* to the device creating a spring force and/or a damping force 8 and in the other end 7*b* to the second helmet part 3. The connection member 7 may be a cord, rope, line, wire or similar elongated bendable member. The device creating a spring force and/or a damping force 8 is connected, attached, fixated or molded into the energy absorbing layer of the first helmet part 2. It is of course also possible to connect the connection member 7 to the first helmet part 2 and the device creating a spring force and/or a damping force 8 to the second helmet part 3. The second end 7*b* may be attached to the helmet part comprising the energy absorbing layer and thus use anchoring means which could be in-moulded, pressed through a hole and expanding on the other side or the like. If the second end 7*b* is to be attached at a shell type of helmet part it could be attached by a loop of the elongated bendable member, threaded through a hole and having a wire lock on the other side or the like.

The device creating a spring force and/or a damping force 8 is in FIGS. 3*a*, 3*b*, 3*d*-3*i*, a moveable dividing wall 8*a* arranged in a housing 8*b*. The at least one connection member 7 is in one end 7*a* connected to the dividing wall 8*a* and in one end 7*b* connected to or adapted to be connected to either one of the first or the second helmet part 2, 3. The device creating a spring force and/or a damping force 8 is adapted to be connected, attached, fixated or molded into the other helmet part 3, 2. The housing 8*b* may be essentially closed off from the surroundings and contain a compressible or non-compressible medium M with a pressure P. When a non-compressible medium is used, the dividing wall 8*a* is arranged to permit a leak of medium over the dividing wall in order to create the damping force, for example by arranging holes in the wall 8*a* or having a gap between the edges of the wall 8*a* and the housing 8*b*. In order for the dividing wall to return to its original position at least one spring 8*c* may be arranged to act upon said dividing wall 8*a* to create a spring force. Said spring 8*c* may be a linear, non-linear or progressive spring of any kind.

In FIG. 3*a* at least two, but preferably three or four, connection arrangements 6 are used to control the relative movement between the first 2 and the second 3 helmet part. The connection arrangements 6 may for example be placed adjacent each other near the top part of the helmet or placed on at a distance from each other. If a single acting connection member, where the force is absorb in only one direction, is used, as disclosed in FIGS. 3*b*-*f*, 3*h*, 3*i*, two oppositely directed connection members are preferably placed in line with each other. Each connecting arrangement 6 comprises a connection member 7 in the form of an elongated bendable non-elastic member and a device creating a spring and/or damping force 8 in the form of a housing 8*b* comprising a moveable dividing wall 8*a*. The connection member 7 is connected to the second helmet part 3 and the device creating a spring and/or damping force 8 is molded into the energy absorbing layer 5 of the first part 2. When an oblique impact force act on the second helmet part 3 and moves it in relation to the first helmet part 2, the bendable member 7 will follow the movement of the second part 3, even if it is not in the same direction as the axis of the housing 8*b*, and move the wall 8*a* within the housing 8*b*. Thus, the wall 8*a* press on the non-compressible or compressible medium and/or on the spring 8*c* creating a spring and/or a damping force which is essentially opposite to the oblique impact force. This movement is visualized in FIGS. 2*a* and 2*b*, although in those figures the bendable member 7 is connected to the first part 2 and the device creating a spring force and/or a damping force 8 is connected to the second part 3.

The device creating a spring force and/or a damping force 8 of the first embodiment may have different designs as shown in FIGS. 3*b*-3*j*.

Figure 3C:
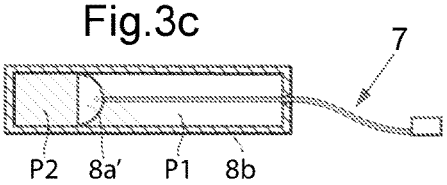
FIG. 3*c* shows a detail view of the first embodiment of a connection arrangement comprising a second embodiment of a device for creating a spring and/or damping force.

In FIG. 3*c* the device creating a spring force and/or a damping force 8 is an elastic dividing wall 8*a*', for example a membrane made of an elastic material, attached to the walls of a housing 8*b*. The at least one connection member 7 is in one end 7*a* connected to the dividing wall 8*a*' and in the other end 7*b* adapted to be connected to either one of the first or the second helmet part 2, 3. The device creating a spring force and/or a damping force 8 is adapted to be connected, attached, fixated or molded into the other helmet part 3, 2. The housing 8*b* is essentially closed off from the surroundings and contains a compressible or non-compressible medium M such as gas or liquid. The pressures P1, P2 in the medium M varies when the wall 8*a*' bulges. When a non-compressible medium is used the dividing wall 8*a*' is arranged to permit a leak of medium over the dividing wall in order to create a damping force.

Figure 3D:
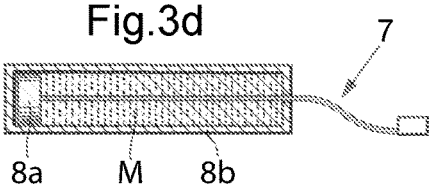
FIG. 3*d* shows a detail view of the first embodiment of a connection arrangement comprising a third embodiment of a device for creating a spring and/or damping force.

In FIG. 3*d* no separate spring is used. Instead the dividing wall 8*a* acts upon a compressible material M such as a foam, sponge, liquid or gas.

Figure 3E:
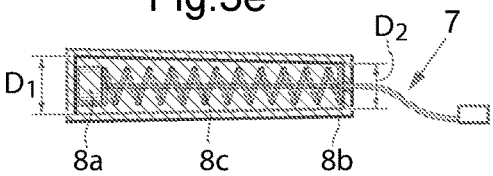
FIG. 3*e* shows a detail view of the first embodiment of a connection arrangement comprising a fourth embodiment of a device for creating a spring and/or damping force.

In FIG. 3*e* a damping force is created by a narrowing diameter of the housing 8*b* towards the end of the housing where the connecting member 7 runs through the housing 8*b*. The housing is preferably filled with a damping medium of some kind. When the dividing wall 8*a* is moved from its neutral end position in the large diameter D1 part of the housing 8*b*, where no forces act on the wall, to the end of the housing with the smaller diameter D2, the passage for the damping medium between the edges of the wall and the housing is decreased. Thus, an increasing damping force is created. A spring may also be inserted in the housing to create a spring force.

Figure 3F:
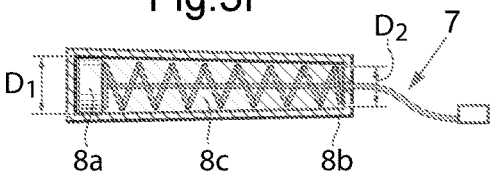
FIG. 3*f* shows a detail view of the first embodiment of a connection arrangement comprising a fifth embodiment of a device for creating a spring and/or damping force.

In FIG. 3*f* a damping force is also created by a narrowing diameter D1, D2 of the housing 8*b* towards the end of the housing where the connecting member 7 runs through the housing 8*b*. However, in this embodiment the increased damping force is created by either using a dividing wall 8*a* made of a compressible material or to use an elastic housing possible to deform when the dividing wall 8*a* is moved towards the narrowing part of the housing. A spring may also be inserted in the housing to create a spring force.

Figure 3G:
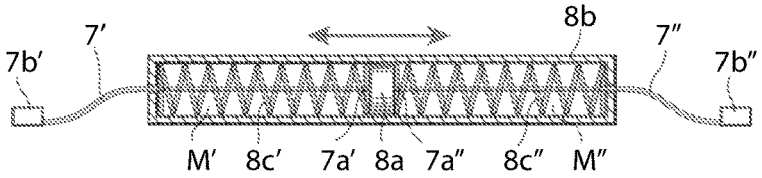
FIG. 3*g* shows a detail view of the first embodiment of a connection arrangement comprising a sixth embodiment of a device for creating a spring and/or damping force.

In FIG. 3*g* two connection members 7', 7" are in one end 7*a*', 7*a*" connected to the dividing wall 8*a* running through each end of the housing 8*b*. The connection members 7', 7" are in their other ends 7*b*', 7*b*" adapted to be connected to the first and the second part 2, 3, respectively. The dividing wall 8*a* has its neutral position, when no forces act on it, essentially in the middle of the housing 8*b*. Springs 8*c*', 8*c*" and/or a damping medium M', M" are arranged on the opposite sides of the wall 8*a*, creating a spring and/or a damping force when the wall 8*a* moves in both directions.

Figure 3H:
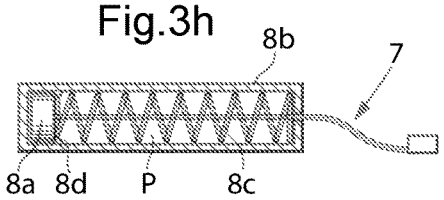
FIG. 3*h* shows a detail view of the first embodiment of a connection arrangement comprising a seventh embodiment of a device for creating a spring and/or damping force.
Figure 3I:
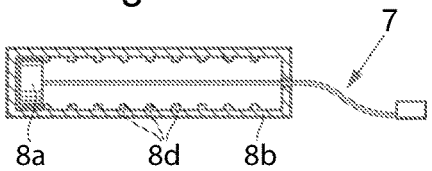
FIG. 3*i* shows a detail view of the first embodiment of a connection arrangement comprising a eight embodiment of a device for creating a spring and/or damping force.

In FIGS. 3*h* and 3*i* the housing comprises notches, slots or friction increasing members 8*d* controlling the movement of the dividing wall. In FIG. 3*h* a notch 8*d* is used as an initial movement stop. The force pulling in the connection member 7 and thus moves the dividing wall 8*a* must be over a certain level before the wall can move over the notch 8*d*. In FIG. 3*i* several notches are arranged in the housing controlling the movement of the dividing wall. The notches 8*d* may also be of a material increasing the friction between the dividing wall 8*a* and the housing 8*b*. It is also possible to arrange notches or slots 8*d* on the inner wall of the housing 8*b* in a patter similar to a thread. These spiral shaped notches or slots 8*d* guide the dividing wall 8*a* in the housing such that it creates a rotational movement of the wall 8*a* in the housing. It is also possible to arrange for example breaking pins that will break upon an predetermined initial force The initial force is preferably in the range 5-500 N.

Figure 3J:
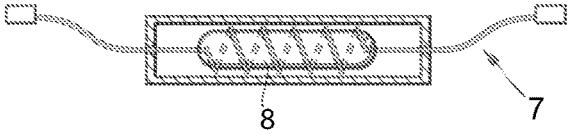
FIG. 3*j* shows a detail view of the first embodiment of a connection arrangement comprising a ninth embodiment of a device for creating a spring and/or damping force.

In FIG. 3*j* the connection member 7 is wound around an elastic or compressible elongated object acting as the device creating a spring and/or damping force 8. This object is for example a rubber cylinder similar to a miniaturized boat mooring snubber or any other types of rubber or foam elongated object.

Figure 3K:
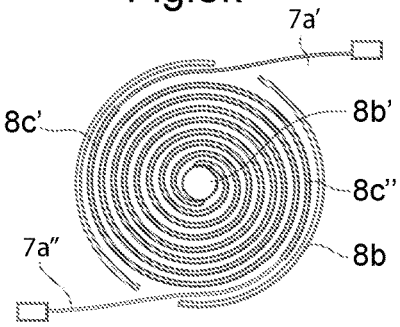
FIG. 3*k* shows a detail view of the first embodiment of a connection arrangement comprising a tenth embodiment of a device for creating a spring and/or damping force.

FIG. 3*k* discloses a dual acting connection arrangement similar to the arrangement according to FIG. 3*g*. Two connection members 7', 7" are in one end 7*a*', 7*a*" connected a first end of an essentially flat torsion spring 8*c*', 8*c*" and are in their other ends 7*b*', 7*b*" adapted to be connected to the first and the second part 2, 3, respectively. The torsion springs 8', 8" are arranged in a cylindrical or essentially cup shaped housing 8*b* comprising a centrally arranged protruding pin 8*b*', to which the second end of the flat torsion springs 8*c*', 8*c*" are attached and around which the springs circle. When a movement between the first and second parts 2, 3 occurs, the respective torsion spring 8*c*', 8*c*" is pulled by the respective connection member 7, 7", thus, creating a spring and/or a damping force In FIGS. 5*a*-5*c* and FIGS. 6*a* and 6*b* a second embodiment of the connection member 7 is shown. The connection member is an elongated rigid member, having the shape of a pin, connected in a first end 7*a* to the first helmet part 2. The connection member could be made of a rigid plastic or a metal, for example. In its second end 7*b* or between its first and second end 7*a*, 7*b* the connection member is connected to the device creating a spring force and/or a damping force 8. The device creating a spring force and/or a damping force 8 is connected, attached, fixated, glued, pressed or molded into the second helmet part. The connection member 7 and the device creating a spring force and/or a damping force 8 may also be fixated to the first or second part for example by means of mechanical fixation elements entering or running through the material of the energy absorbing layer. The mechanical fixation elements may be pieces of Velcro, needles, christmas trees, screws, magnets or other elements. When using this embodiment of a device for creating a spring and/or damping force 8, only one connection arrangement 6 is necessary to connect the first and second part and to control the movement between the parts 2, 3.

It is of course also possible to connect the connection member 7 to the second helmet part 3 and the device creating a spring force and/or a damping force 8 to the first helmet part 2. When an oblique impact force act on the second helmet part 3 the pin 7 interacts with the device creating a spring force and/or damping force 8 and deforms the device 8, thus creating a force which is essentially opposite to the oblique impact force In FIG. 5*b* the device creating a spring force and/or a damping force 8 is a flat spiral torsion spring 8 encircling the connection member 7. When a force from for example an oblique impact, act on the second part a sliding movement of it in relation to the first part is created. Since the pin 7 is attached to the first part a movement of the pin 7 in any direction essentially parallel to the pin 7 is also created. The pin 7 interacts with the torsion spring 8 and twists the spring, thus creating a spring force which is essentially opposite to the oblique impact force. A damping force may also be created, for example by inserting a compressible medium or damping material surrounding the spring.

Figure 5C:
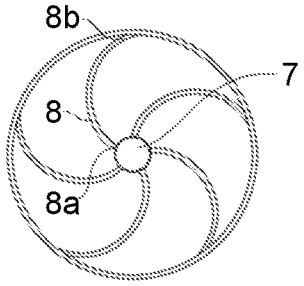
FIG. 5*c* shows detail view of the second embodiment of a connection arrangement comprising a twelfth embodiment of a device for creating a spring and/or damping force.

In FIG. 5*c* at least two, but preferably at least three, devices creating a spring force and/or a damping force 8 are connected to the connection member 7 according to the first embodiment. Said devices creating a spring force and/or a damping force 8 are leaf or spiral springs connected in one end 8*a* to the connection member 7 and in the other end 8*b* to either one of the first or second helmet part (not shown). When an oblique impact force act on the second helmet part (not shown) the pin 7 interacts with the springs 8 and compresses or prolongs the respective springs, thus creating a spring force which is essentially opposite to the oblique impact force. A damping force may also be created, for example by inserting a compressible medium or damping material in an enclosed housing surrounding the separate or all springs.

Figure 6A:
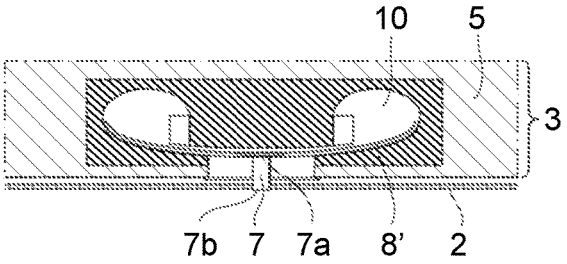
FIG. 6*a* shows a detail side view of an energy absorbing structure comprising the second embodiment of the connection arrangement comprising a thirteenth embodiment of a device for creating a spring and/or damping force.
Figure 6B:
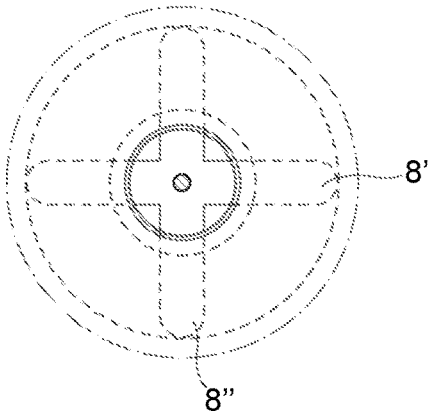
FIG. 6*b* shows a top view of the thirteenth embodiment of a device for creating a spring and/or damping according to FIG. 6*a*.

FIGS. 6*a* and 6*b* shows a fourth embodiment of a device for creating a spring and/or damping force 8 in FIG. 6*a* applied in an energy absorbing structure with a connection member 7 of the second embodiment. The energy absorbing structure may be a helmet of the first type where the device for creating a spring and/or damping force 8. It may also be a helmet of any other type. When using this embodiment of a device for creating a spring and/or damping force 8 only one connection arrangement 6 is necessary to connect the first and second part and to control the movement between the parts 2, 3. The device creating a spring and/or damping force is in this embodiment at least two crossing bendable objects 8', 8" acting as leaf springs. It is also possible to use three or more bendable objects joined at a center point. At their intersection or center point, the first end 7*a* of the pin 7 is attached. The other end 7*b* of the pin is attached to the first part 2. The free ends of the bendable objects 8', 8" are placed in a hollow space 10 arranged in the second part 3 or in a separate part attached to the second part 3. The hollow space 10 has a smooth and curve shaped inner surface. Thus, when the second part 3 starts to slide, the bendable objects 8, 8" slide on the curve shaped inner surface of the hollow spade 10, bend and adjust their shape after the curve shaped surface. This bending movement absorbs energy and counteracts the sliding movement between the first and second part 2, 3.

In all embodiments shown having the second embodiment of the connection member 7 it is possible to use notches, ridges, break pins or the like to increase initial or necessary force for the movement between the first and second parts 2, 3.

Please note that any embodiment or part of embodiment as well as any method or part of method could be combined in any way. All examples herein should be seen as part of the general description and therefore possible to combine in any way in general terms.

The invention claimed is:

1. A helmet comprising a first helmet part;

a second helmet part arranged radially outside of the first helmet part such that the first helmet part is configured to be closer to the wearer's head than the second helmet part; and at least one connection arrangement located between the first and second helmet parts and connecting the first and the second helmet parts;

wherein the at least one connection arrangement is adapted to allow sliding movement between the first and the second helmet part in any direction parallel to a surface of the first or second helmet part, said surface being adapted to slide against a surface of the other of the first or second helmet part and comprises:

a housing;

means for creating a spring force and/or damping force in response to sliding movement between the first part and second part so as to absorb energy of the sliding movement between the first part and second part, said means for creating a spring force and/or damping force being provided within the housing and wherein the means for creating a spring force and/or damping force comprising a dividing wall that is at least one of moveable or elastically deformable and at least one spring arranged to act upon the dividing wall; and an inelastic elongated connection member of a fixed length connected, within the housing, at a first end of the connection member to the means for creating a spring force and/or a damping force and connected, external to the housing, at a second end of the connection member opposite the first end to one of the first part and the second part.

2. The helmet according to claim 1, comprising a means for facilitating sliding between the first and second helmet part is arranged between the first and the second helmet part to facilitate a sliding movement between the first and second helmet part in response to a force created by an oblique impact on the first or second helmet part, wherein the means for facilitating sliding comprises a material having a low friction component or coating where the low friction component or coating is selected from a group of low friction materials consisting of: a polytetrafluoroethylene, a polymer of acrylonitrile, butadiene and styrene (ABS), a polyvinylchloride, a polycarbonate, a high-density polyethylene, nylon, a waxy polymer, a polyfluoroalkoxy alkane, a fluorinated ethylene propylene, a polyethylene, an ultra high molecular weight polyethylene, oil, grease, or a combination thereof.

3. The helmet according to claim 1, wherein the connection member is an elongated rigid pin.

4. The helmet according to claim 3, wherein the at least one spring is a torsion, leaf or spiral spring connected to or acting against the at least one connection member and either one of the first or second helmet part.

5. The helmet according to claim 1, wherein the connection member is bendable.

6. The helmet according to claim 5, wherein the housing and the means for creating a spring force and/or a damping force are configured such that movement of first end of the connection member is constrained such that the first end of the connection member moves along an axis through the housing irrespective of the direction of the movement between the first and second helmet parts.

7. The helmet according to claim 1, wherein the housing contains a compressible medium.

8. The helmet according to claim 7, wherein the dividing wall is arranged to permit a leak of medium over the dividing wall creating a damping force.

9. The helmet according to claim 1, wherein the housing contains a non-compressible medium.

10. The helmet according to claim 1, wherein the spring is a linear, non-linear, or progressive spring.

11. The helmet according to claim 1, wherein the housing comprises notches, slots, or friction increasing members controlling the movement of the dividing wall.

* * * * *